United States Patent [19]

Trullás

[11] 3,949,580

[45] Apr. 13, 1976

[54] APPARATUS FOR THE WET TREATMENT OF CLOTHS

[75] Inventor: Isidro Folch Trullás, Tarrasa, Spain

[73] Assignee: Argelich Termes Y CIA., Sociedad Anonima, Tarrasa, Spain

[22] Filed: Mar. 24, 1975

[21] Appl. No.: 561,509

[30] Foreign Application Priority Data

Mar. 27, 1974 Spain ..... 424689

[52] U.S. Cl. ..... 68/177; 68/184

[51] Int. Cl.[2] ..... D06B 3/24; D06B 3/28

[58] Field of Search ..... 68/177, 178, 184

[56] References Cited

UNITED STATES PATENTS

| | | | |
|---|---|---|---|
| 3,497,311 | 2/1970 | Masuda | 68/177 X |
| 3,762,189 | 10/1973 | Marsh et al. | 68/177 |
| 3,771,337 | 11/1973 | Trullas | 68/178 |
| 3,782,138 | 1/1974 | Kawasaki et al. | 68/177 |

FOREIGN PATENTS OR APPLICATIONS

| | | | |
|---|---|---|---|
| 1,513,008 | 1/1968 | France | 68/177 |

*Primary Examiner*—Stanley N. Gilreath
*Assistant Examiner*—Philip R. Coe
*Attorney, Agent, or Firm*—Sughrue, Rothwell, Mion, Zinn & Macpeak

[57] ABSTRACT

An apparatus for the wet treatment of cloths in rope form having a tubular body substantially of L shape, the cross section being variable and greater in the vertical arm than in the horizontal arm; a transport duct has a portion having an inlet port inside the vertical arm, comes out and runs to the remote end of the horizontal arm at a lower level; the liquid is caused to flow through the transport duct by a pump feeding an overflow chamber at top of the transport duct and a jet chamber located below the overflow chamber, inside or outside the main vessel; the liquid flow is adjusted by appropriate valves in the pump circuit; a motor driven winch cooperates with the liquid in drawing the cloth through the bath, a major portion of the cloth moving at a slower rate through the main vessel than through the transport duct; a heat exchanger is incorporated in the pump circuit.

9 Claims, 4 Drawing Figures

APPARATUS FOR THE WET TREATMENT OF CLOTHS

FIELD OF THE INVENTION

The present invention relates to improvements in apparatus for the wet treatment of cloths wherein the cloth, in endless rope form, is moved through a closed, pressurised or non-pressurised circuit, by the treatment liquid itself, the cloth moving at a high speed through a transport duct portion and at a slow speed through a storage vessel portion where a major portion of the cloth accumulates. This invention allows the overall apparatus dimensions to be reduced, the manufacturing costs to be lowered, the bath/material ratio to be reduced and also enables the apparatus to be used full or half full for use with small quantities of cloth as the case may be.

SUMMARY OF THE INVENTION

The improvements are characterised in that the closed vessel comprises in combination:

a. an elongate tubular center portion acting as storage chamber for the treatment liquid and cloth to be treated;

b. a tubular end portion, attached to the entrance end of the center portion, having an entrance end of smaller section than its exit end, receiving the liquid and cloth in their path towards the storage chamber;

c. an upwardly directed elbow portion attached to the exit end of the center portion and forming part of the storage chamber;

d. a transition portion attached to the elbow portion, having a larger cross sectional area at its exit end than at its entrance end;

e. an upper portion, attached to the transition portion, having a larger cross sectional area than the center portion, with a loading and unloading cover, housing the upper portion of a transport duct;

f. a transport duct running below the storage chamber and communicating the upper portion with the end portion to complete the vessel's closed circuit;

g. drive means consisting of a horizontal winch driven by a variable speed motor, on the periphery of which the cloth rests for delivery to the transport duct through a suitably disposed inlet port, for drawing the cloth along in cooperation with an overflow chamber and a jet chamber adjacent said transport duct; and h. a flow pump having its suction pipe in communication with the storage chamber to draw liquid therefrom, while the discharge pipe communicates with the overflow and jet chambers through a heat exchanger, said pipes and their branches having adjustable liquid flow valves for controlling the movement of the liquid and the cloth through the apparatus.

The transport duct is provided with a side port for cloth entry at the height of the transition portion. In a further embodiment, said duct receives the cloth through an end port located in the upper portion.

In one embodiment of the invention, the cloth delivery winch is housed in the transition portion, while the overflow chamber is located around the end port and the jet chamber is located below the side port.

In a further embodiment of the invention, the winch is located over the end port surrounded by the overflow chamber, while the jet chamber is below said overflow chamber.

The storage chamber may be provided with suction chambers having each a branch pipe, forming part of the pump suction pipe and having adjusting valves, extending therefrom.

The end portions of the storage chamber may communicate with each other through a by-pass pipe having a flow valve to balance the liquid outlet flow.

The apparatus may have a duct communicating the lower end of the upper portion with the entry end portion and containing an accumulator chamber for collecting any liquid which rises above the upper level of the closed vessel, to prevent it from entering in said upper body portion.

The upper chamber may have an apron member located above the cloth inlet port in front of the winch to avoid possible offsetting of the cloth with respect to said port.

BRIEF DESCRIPTION OF THE DRAWINGS

In order to facilitate the understanding of the foregoing ideas and at the same time disclose certain constructional features, the invention will be disclosed in detail in the following description, with reference to the attached illustrative drawings in which.

DETAILED DESCRIPTION OF THE INVENTION

Figure 1:
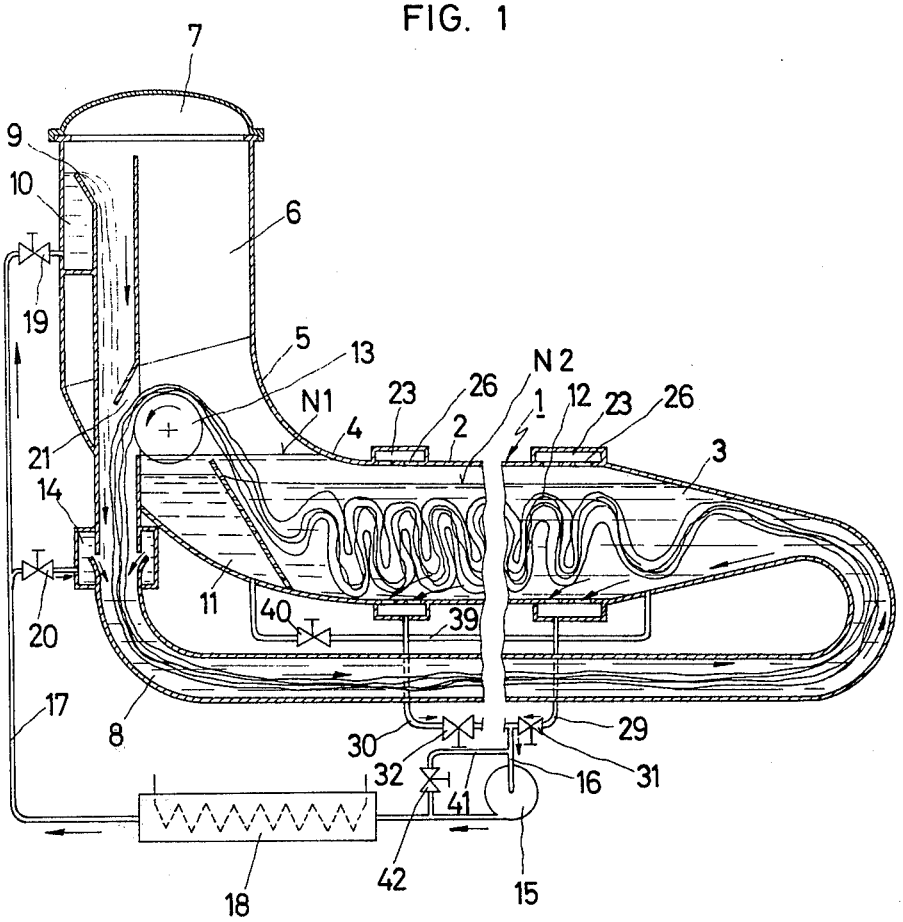
FIGS. 1, 2 and 3 are diagrammatic, longitudinal section views of different embodiments of the apparatus of the invention.

The apparatus comprises essentially a closed vessel 1, adapted for operating under pressure or as an open bath, comprising a center tubular portion 2 connected to a tubular entry end portion 3 and an exit elbow portion 4, which curves in an upward direction and is attached to a transition portion 5 having its greater cross sectional area at its top end, attached in turn to an upper portion 6 provided with a loading and unloading cover 7. The upper portion 6 and the end portion 3 communicate one with the other externally through a transport duct 8 which, within said upper body portion 6, forms an axial port 9 surrounded by an overflow chamber 10. Said transport duct 8 extends under the storage chamber formed in said center portion 2 and adapted to contain treatment liquid 11 for an endless rope of cloth 12.

The apparatus drive means comprise a horizontal winch 13 driven by a variable speed motor, on which the cloth 12 rests for its delivery to the transport duct 8.

The apparatus also comprises a jet chamber 14 cooperating in the movement of the cloth 12 and a flow pump 15 having a suction pipe 16 and discharge pipe 17 which passes through a heat exchanger 18 to discharge in the overflow and jet chambers 10 and 14 through separate outlets each having an adjusting valve 19 and 20, respectively.

Figure 2:
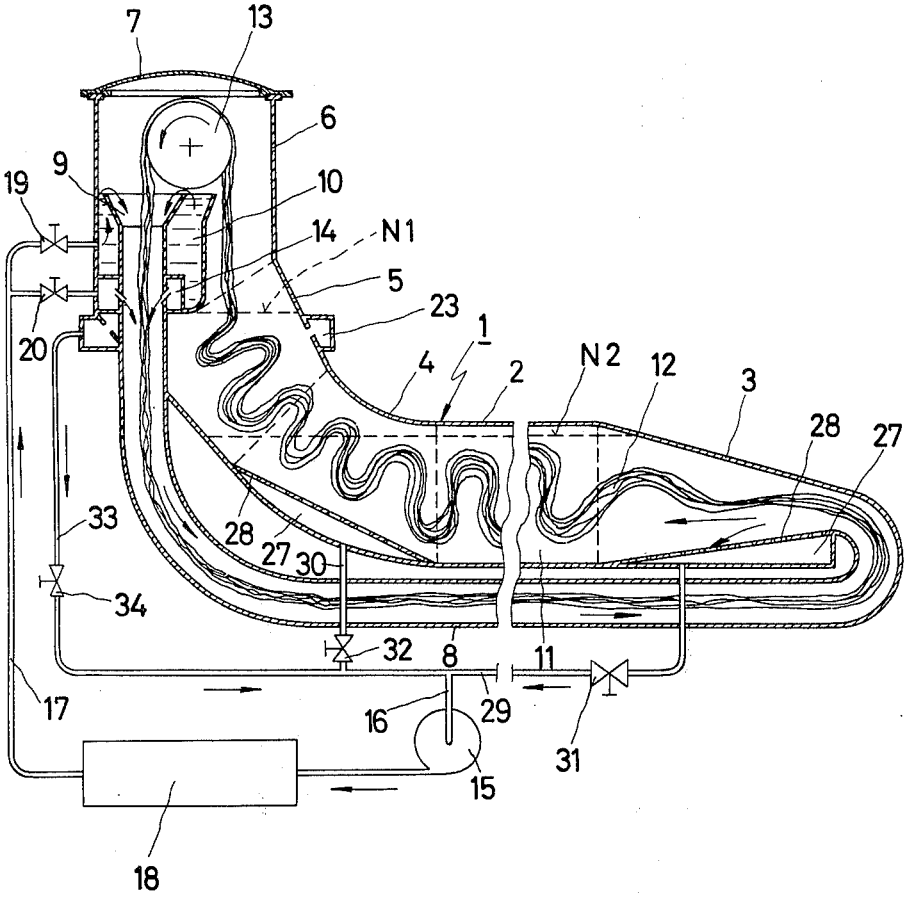
Figure 3:
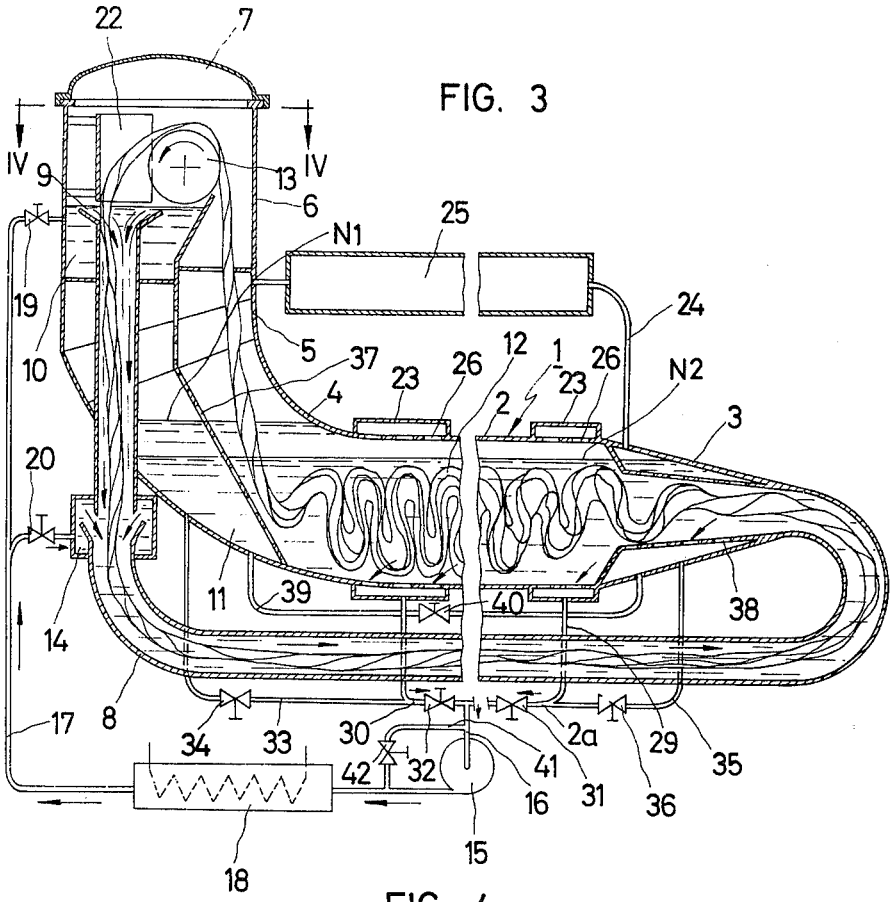
Figure 4:
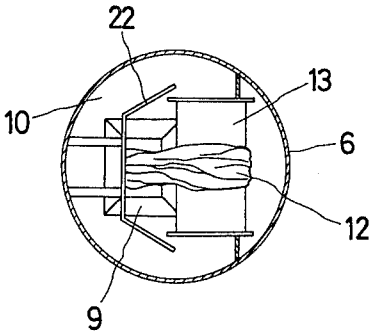
FIG. 4 is a sectional view along a line IV—IV of FIG. 3.

In the embodiment of FIG. 1, the winch 13 is housed within the transition portion 5 and delivers the cloth 12 through an aperture 21 in the sidewall of the transport duct 8, said jet chamber 14 being located below said aperture 21 outside the closed vessel 1. In the embodiments of FIGS. 2 and 3, said winch 13 is housed in the upper body 6, above port 9, there being in the case of the FIG. 3 embodiment an apron member 22 facing the winch 13 to avoid possible offsetting of the cloth 12 with respect to port 9.

The jet chamber 14 of the FIG. 2 embodiment is located immediately below the overflow chamber 10, with liquid passages. It may also be provided with an annular suction chamber 23. In the FIG. 3 embodiment said jet chamber is arranged as in the FIG. 1 embodiment.

In said FIG. 3 embodiment there is also a duct 24 communicating the upper portion 6 with the entry portion 3 through an accumulator chamber to prevent the liquid 11 from reaching the overflow chamber 10.

In the FIGS. 1 and 3 embodiments, there are annular suction chambers 23 around the center portion 2, provided with a grille 26 allowing liquid to be aspirated therefrom. In the FIG. 2 embodiment, there are lower regions 27 with grille 28 for the same purpose.

Other accessory differences between the three cases described affect the intercommunication system between the pump 15 and the closed vessel 1. The suction pipe 16 divides to form further ducts 29 and 30 with flow adjustment valves 31 and 32 to communicate with the annular chambers 23 or lower regions 27. Also, in the FIG. 2 embodiment, said duct 30 communicates in turn with the annular chamber 23 through a further duct 33 having a valve 34, while in FIG. 3 both ducts 29 and 30 divide into ducts 33 and 35 having valves 34 and 36 to communicate with end spaces of the closed vessel 1 which are fitted with separator grilles 37 and 38. In the FIGS. 1 and 3 embodiments, also, there is a duct 39, with valve 40 communicating between the end portions of the closed vessel, in form of a by-pass, as well as a further by-pass 41, with valve 42 arranged for the pump 15.

The apparatus works as follows: when the winch 13 and pump 15 are running, the liquid flows through the closed circuit 1 together with the cloth 12 which is drawn along by both elements, at a high speed through the transport duct 8 and at a slow speed through the storage chamber of the center portion 2 where the major portion of the cloth 12 is accumulated. During this operation the liquid may reach an upper level N1 for a complete bath or a lower level N2 for a half bath.

The heat exchanger 18 is used for steam or cold water flow to condition the bath as the liquid 11 flows through the heat exchanger.

The overflow chamber 10 and jet chamber 14, independently of the location of the latter, aid in moving the cloth 12 as a result of the thrust they provide. There is possibility for adjustment by way of the different flow adjustment valves of the pump circuit 15.

Outstanding features of the apparatus of the invention, in the different versions described, are its peculiar elbow form making it compact, since the return run is made without the need of diverse compartments as in ordinary apparatus, and the possibility of using the apparatus at low capacity, allowing it to operate with small amounts of cloth or just for samples.

This apparatus may be coupled to other similar machines using already known systems to form a battery comprising two or more apparatus with a common flow pump and heat exchanger for the whole battery. Also two apparatus with two pumps and two heat exchangers or two groups of the above two systems may be coupled together.

Having suitably described the features of the invention, it is stated that as many variations of detail as advised by experience may be introduced therein, provided that thereby the essence of the invention as resumed and defined in the following claims is not modified.

What I claim is:

1. In an apparatus for the wet treatment of cloths, wherein the cloth, in endless rope form, is moved through a closed, pressurised or non-pressurised circuit by the treatment liquid itself, the cloth moving at a high speed through a transport duct portion and at a slow speed through a storage vessel portion where a major portion of the cloth accumulates, the improvements which consist in providing a closed vessel comprising in combination:

a. an elongate tubular center portion acting as a storage chamber for the treatment liquid and cloth to be treated, said elongate tubular center portion having an entrance end and an exit end;

b. a tubular end portion attached to the entrance end of the center portion for receiving the liquid and cloth in their path towards the storage chamber, said tubular end portion having an entrance end and an exit end, said entrance end being of smaller cross section than its exit end;

c. an upwardly directed elbow portion attached to the exit end of the center portion and forming part of the storage chamber;

d. a transition portion, attached to the elbow portion, having an entrance end and an exit end, said exit end having a larger cross sectional area than its entrance end;

e. an upper portion, attached to the transition portion, having a larger cross sectional area than the center portion, said upper portion having a loading and unloading cover:

f. a transport duct having an upper section housed in said upper portion and a lower section running below the storage chamber, said transport duct communicating the upper portion with the end portion to complete the vessel's closed circuit, said transport duct further having an inlet port;

g. drive means consisting of a horizontal winch, driven by a variable speed motor, said winch having a periphery on which the cloth rests for delivery to the transport duct through said inlet port, an overflow chamber and a jet chamber adjacent said transport duct, said overflow and jet chambers cooperating with said inlet port for drawing the cloth into said transport duct through said inlet port; and h. a circulation pump having a suction pipe in communication with the storage chamber to draw liquid therefrom and a discharge pipe in communication with the overflow and jet chambers through a heat exchanger, said pipes having branches, said pipes and branches having adjustable liquid flow valves for controlling the movement of the liquid and the cloth through the apparatus.

2. The improvements of claim 1, wherein the inlet port of said transport duct is a side port at the height of the transition portion.

3. The improvements of claim 1, wherein the inlet port of said transport duct is an end port located in the upper portion.

4. The improvements of claim 1, wherein the winch is located in the transition portion, the overflow chamber is located above the inlet port, and the jet chamber is located below the inlet port.

5. The improvements of claim 1, wherein the winch is located above the overflow chamber and the jet chamber is located below said overflow chamber.

6. The improvements of claim 1, wherein the storage chamber is provided with suction chambers having branch pipes forming part of the pump suction pipe, all of said pipes having adjusting valves extending therefrom.

7. The improvements of claim 1, wherein the ends of the storage chamber communicate with each other through a by-pass pipe having a flow valve to balance liquid outlet flow from said storage chamber.

8. The improvements of claim 1, wherein said upper portion has a lower section, a duct communicating said lower section with the tubular end portion, said duct containing an accumulator chamber for collecting any liquid rising above the upper level of the closed vessel to prevent it from entering in said upper portion.

9. The improvements of claim 1, wherein the upper portion houses an apron member located above the cloth inlet port in front of the winch to avoid possible offsetting of the cloth with respect to said port.

* * * * *